US009560698B2

(12) United States Patent
Giraud et al.

(10) Patent No.: US 9,560,698 B2
(45) **Date of Patent: *Jan. 31, 2017**

(54) APPARATUS AND METHODS FOR CARTRIDGE CASE ANNEALING

(71) Applicant: GIRAUD TOOL COMPANY, INC., Richmond, TX (US)

(72) Inventors: Douglas Hilton Giraud, Richmond, TX (US); David Bland Alden, Beach City, TX (US)

(73) Assignee: GIRAUD TOOL COMPANY, INC., Richmond, TX (US)

( * ) Notice: Subject to any disclaimer, the term of this patent is extended or adjusted under 35 U.S.C. 154(b) by 298 days.

This patent is subject to a terminal disclaimer.

(21) Appl. No.: 14/256,208

(22) Filed: Apr. 18, 2014

(65) Prior Publication Data

US 2014/0224788 A1 Aug. 14, 2014

Related U.S. Application Data

(63) Continuation of application No. 13/156,229, filed on Jun. 8, 2011, now Pat. No. 8,728,386.

(51) Int. Cl.

| | |
|---|---|
| ***C21D 9/16*** | (2006.01) |
| ***B21D 51/54*** | (2006.01) |
| ***B21K 21/04*** | (2006.01) |
| ***H05B 6/02*** | (2006.01) |
| ***C21D 9/00*** | (2006.01) |
| ***C22F 1/08*** | (2006.01) |
| ***F27D 3/00*** | (2006.01) |
| *C21D 1/00* | (2006.01) |

(52) U.S. Cl.

CPC ..... *H05B 6/02* (2013.01); *C21D 9/0068* (2013.01); *C21D 9/16* (2013.01); *C22F 1/08* (2013.01); *F27D 3/00* (2013.01); *F27D 2003/0042* (2013.01)

(58) Field of Classification Search

CPC ..... C21D 9/0068; C21D 9/16; F27D 3/00; F27D 2003/0042; B21D 51/54; B21K 21/04

USPC ..... 86/19.5, 19.6, 19.7

See application file for complete search history.

(56) References Cited

U.S. PATENT DOCUMENTS

| | | | |
|---|---|---|---|
| 2,907,858 | A | 10/1959 | Distler |
| 2,937,017 | A | 5/1960 | Carbo |
| 3,005,894 | A | 10/1961 | Carbo et al. |
| 3,829,650 | A | 8/1974 | Armstrong |
| 4,090,698 | A | 5/1978 | Mucha et al. |

(Continued)

OTHER PUBLICATIONS

Enterprise Services, LLC, Anneal-Rite Cartrigde Case Annealing Machine, http://www.cartridgeaneal.com//, Feb. 16, 2011, pp. 1-5.

(Continued)

*Primary Examiner* — Lois Zheng

(74) *Attorney, Agent, or Firm* — Patterson & Sheridan, L.L.P.

(57) ABSTRACT

In one embodiment, a case transfer apparatus includes a base, a feeding device having a first end tapering to a second end that is coupled to the base, a motor disposed on the base, a rotatable feed wheel assembly disposed on the base and coupled to the motor, the rotatable feed wheel assembly adapted to receive at least one case via gravitational force from a feeding device, and a roller plate coupled to the motor and disposed adjacent the rotatable feed wheel assembly within a case receiving region where the at least one case is rotated and heated.

20 Claims, 12 Drawing Sheets

(56) References Cited

U.S. PATENT DOCUMENTS

2006/0016524 A1 1/2006 Scharch

OTHER PUBLICATIONS

New, Versatile Brass-O-Matic Annealing Machine << Daily Bulletin, http://bulletin.accurateshooter.com/2007/11/new-versatile-brass-o-matic-annealing-machine/, Feb. 16, 2011, pp. 1-3.
Light, Ken, Cartridge Case Annealing with the BC-1000 Annealer, When, why, how and if to anneal, http://www.kenlightmfg.com/cartridgecaseannealer.htm, Feb. 16, 2011, pp. 1-16.
Ballistic Edge Mfg—Model 360, http://www.annealingmachines.com/model_360, Feb. 16, 2011, pp. 1-4.
Ballistic Edge Mfg—model 400, http://www.annealingmachines.com/model_400, Feb. 16, 2011, pp. 1-6.
Bench-Source Annealing Machine, Model: 10G107, Vertex Manufacturing Corporation, Form Man10G107 Rev. -A-, Mar. 26, 2010, pp. 1-16.

APPARATUS AND METHODS FOR CARTRIDGE CASE ANNEALING

CROSS-REFERENCE TO RELATED APPLICATION

This application is a continuation of U.S. patent application Ser. No. 13/156,229, filed Jun. 8, 2011, which application is hereby incorporated by reference herein.

BACKGROUND OF THE INVENTION

1. Field of the Invention

Embodiments of the invention generally relate to a method and apparatus for annealing metallic objects. More specifically, embodiments described herein relate to a method and apparatus for annealing elongated, tubular cases made of a metallic material, such as brass ammunition cartridges, or ammunition cases or casings.

2. Description of the Related Art

Annealing is a process where heat is applied to a metal in order to change the properties, such as strength and hardness, of the metal. Annealing is typically utilized to improve ductility, relieve internal stresses, and generally soften metals that have been hardened by working the metal and/or heat treatment. Proper annealing restores the properties of the metal to a near original or virgin state.

Ammunition cartridges or cases are made from brass which is subject to hardening during manufacture, use, and reloading of the cases. Commercially available cartridges are typically annealed during manufacture to include various hardnesses along the length of the case. For example, firearm cartridges typically include a base at a first end thereof where the primer is located and a mouth at a second end thereof where the projectile is held. In a properly annealed cartridge the mouth will have a greater ductility than the base. However, when the cartridge is used to discharge a projectile, heat is created which causes the case to expand and contract, thus hardening the case, and particularly, the mouth of the case. Reuse (i.e., reloading) of the case requires subsequent processing, such as sizing and trimming of the case, which may work-harden portions of the case. If the hardened portions of the case are not annealed, such as the mouth (or neck, in shouldered cases), the mouth may crack and render the cartridge unusable. Thus, annealing of the cases assures proper operation of the cartridge as well as extends the lifetime of the case for subsequent reuse.

Devices for annealing ammunition cases are commercially available; however, the commercially available devices suffer from some drawbacks. In one commercially available device, only a single case may be loaded and annealed at one time, which is time consuming and labor intensive. Other conventional devices typically hold multiple cases vertically in a turntable that rotates in a horizontal plane. The commercial devices do not include an automatic case loading device. Loading of the turntable is thus done manually to assure that the case is properly oriented in the turntable (e.g., mouth up/base down). This requires constant supervision by personnel during operation to ensure efficient throughput. Further, the horizontally oriented turntable devices are heavy and occupy a large footprint. Additionally, the conventional devices often require more than one heat source, which increases the cost of the annealing operation. While these conventional devices may be suitable for the occasional user, the devices are not desirable for commercial operations and/or frequent users.

Thus, there exists a need in the art for a method and apparatus for an annealing device capable of automatic loading of cases, high-throughput and requires a smaller footprint.

SUMMARY OF THE INVENTION

Embodiments described herein relate to a method and apparatus for annealing elongated, tubular casings made of a metallic material, such as brass ammunition cases. In one embodiment, a case transfer apparatus includes a base, a feeding device having a first end tapering to a second end that is coupled to the base, a motor disposed on the base, a rotatable feed wheel assembly disposed on the base and coupled to the motor, the rotatable feed wheel assembly adapted to receive at least one case via gravitational force from a feeding device, and a roller plate coupled to the motor and disposed adjacent the rotatable feed wheel assembly within a case receiving region where the at least one case is rotated and heated.

In another embodiment a case transfer apparatus includes a base, a motor coupled to the base, a feed wheel assembly coupled by a shaft to the motor, a linear slide mechanism disposed adjacent the feed wheel assembly, the linear slide mechanism movable in a linear direction that is controlled by the motor, and a case receiving region contained between the feed wheel assembly and the linear slide mechanism where at least one case is rotated and heated.

In another embodiment a case transfer apparatus includes a body comprising a front panel and two opposing walls, the front panel oriented in an acute angle relative to a horizontal plane, a feeding device coupled to and coplanar with the front panel, a rotatable feed wheel assembly disposed adjacent an end of the feeding device, and a linear slide mechanism disposed adjacent the rotatable feed wheel assembly defining a case receiving region comprising two spaced-apart guide rails disposed between the feed wheel assembly and the linear slide mechanism where at least one case is rotated and heated in a fixed rotational axis.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments described herein relate to a method and apparatus for annealing elongated, tubular casings made of a metallic material. The casings or cases as described herein include cylindrical ammunition cartridges, but may also include other workpieces, such as pieces of small diameter pipe and polygonal tubing. Various embodiments described herein may be described in relation to independent directions and/or in horizontal and vertical planes. Vertical is defined as orthogonal to a horizontal direction or plane and will be referred to as the Z direction. Horizontal is defined as orthogonal to a vertical direction or plane and will be referred to as the X or Y direction, the X direction being orthogonal to the Y direction, and vice-versa. The X, Y, and Z directions will be further defined with directional insets included as needed in the Figures to aid the reader.

Figure 1A:
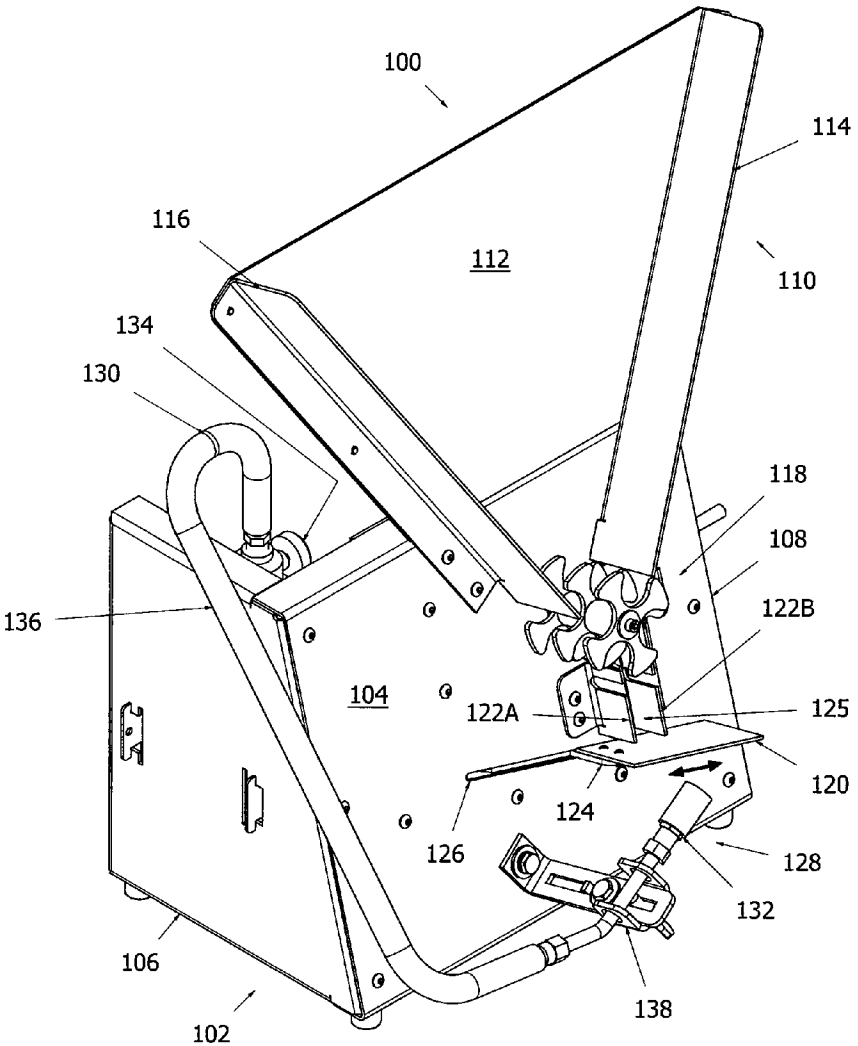
FIG. 1A is an isometric front left view of one embodiment of a case annealing apparatus.
Figure 1B:
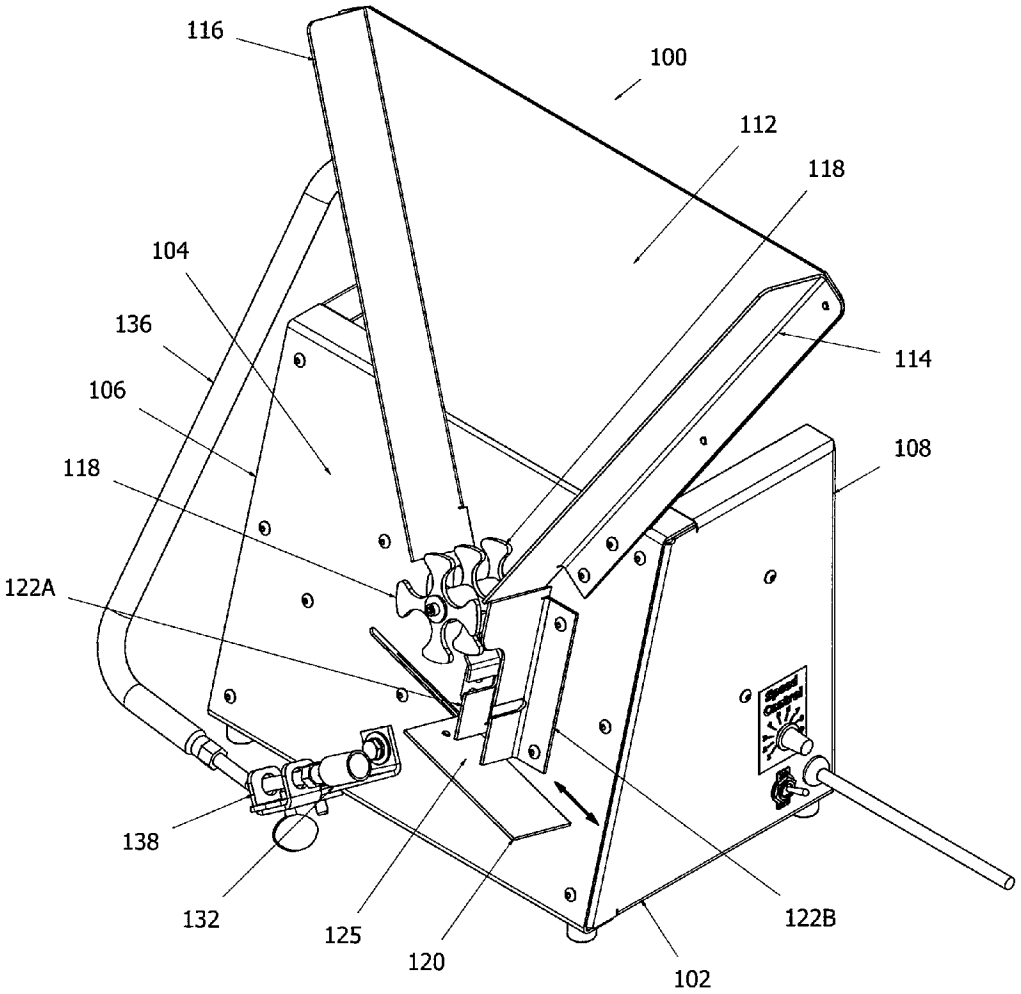
FIG. 1B is an isometric front right view of the case annealing apparatus of FIG. 1A.

FIGS. 1A-1D depict various isometric views of one embodiment of a case annealing apparatus 100. FIG. 1A is front left view of the case annealing apparatus 100 and FIG. 1B is a front right view of the case annealing apparatus 100. The case annealing apparatus 100 comprises a body 102 including a front panel 104, a left side panel 106, and a right side panel 108. The case annealing apparatus 100 also includes a feeding device 110 coupled to the front panel 104. The feeding device 110 includes a back plate 112, a first side rail 114, and a second side rail 116 coupled to opposing sides of the back plate 112. In one embodiment, the feeding device 110 comprises a magazine adapted to contain and feed cases (not shown) to a feed wheel assembly 118. In one embodiment, the back plate 112 of the feeding device 110 includes a first end that is larger (i.e., a greater distance between the side rails 114, 116) that tapers toward a smaller second end such that the feeding device 110 comprises a substantially triangular, funnel shape. The side rails 114, 116 are coupled to the back plate 112 to converge to define a gap near the feed wheel assembly 118, thereby gravity feeding cases to the feed wheel assembly 118 through the gap between the ends of the side rails 114, 116 during operation.

The case annealing apparatus 100 also comprises a roller plate 120 adjacent a first guide rail 122A and a second guide rail 122B. In one embodiment, the roller plate 120 comprises a linear slide plate that is coupled to support member 124. The upper surface of the roller plate 120, the first guide rail 122A, and the second guide rail 122B form a case receiving region 125. The support member 124 extends through a slot 126 formed in the front panel 104. The support member 124 is in selective communication with a geared timing wheel (shown in FIGS. 1C and 1D) on the backside of the front panel 104 that is adapted to move the support member 124 and the roller plate 120 in the direction indicated by the arrow shown in FIGS. 1A and 1B.

Figure 1C:
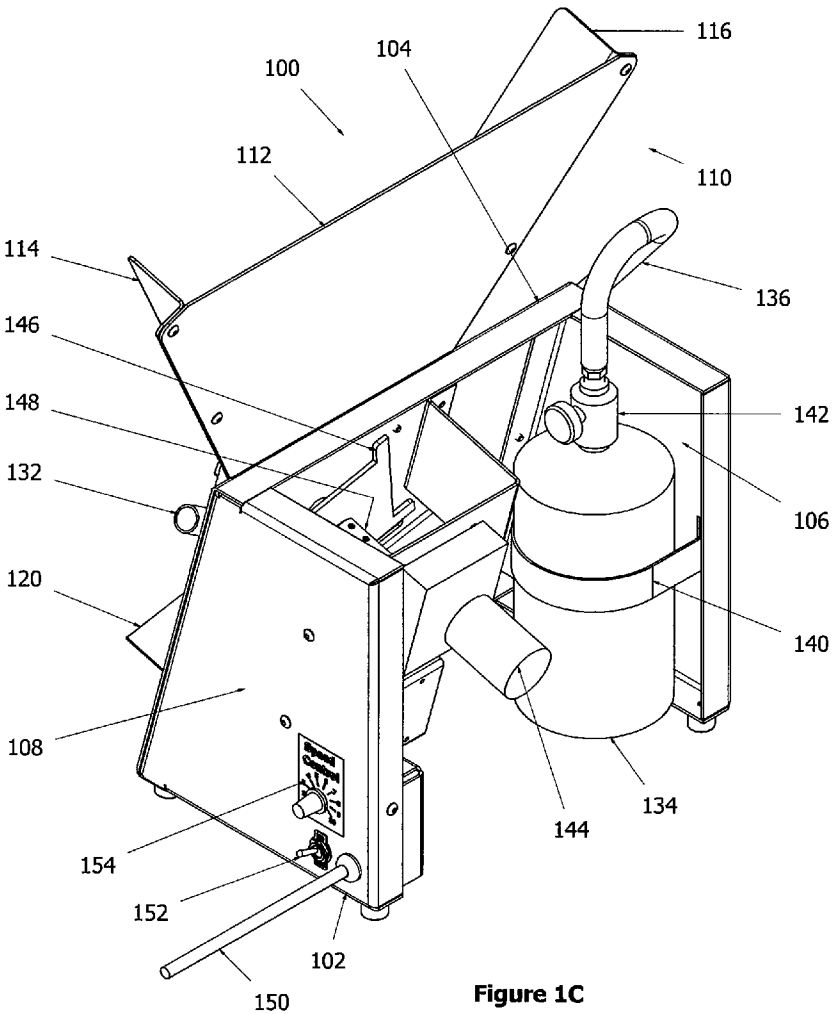
FIG. 1C is an isometric back right view of the case annealing apparatus of FIG. 1A.
Figure 1D:
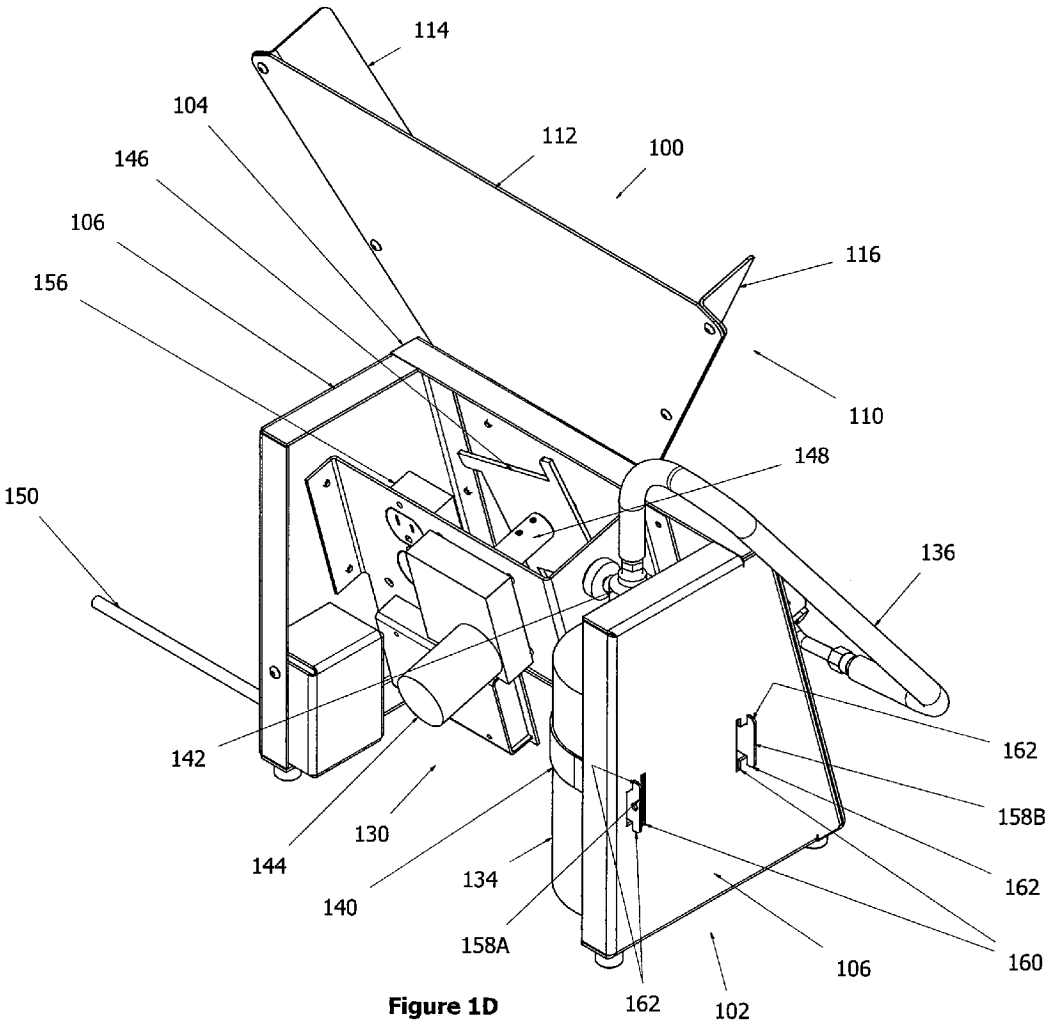
FIG. 1D is an isometric back left view of the case annealing apparatus of FIG. 1A.

The case annealing apparatus 100 also comprises a heat source 128 adjacent the roller plate 120. The heat source 128 may comprise a heating device adapted to emit thermal energy and transfer heat by conduction, convection, or radiation. The heat source 128 may provide thermal energy by combustion, electricity, or optically. In the embodiment shown in FIGS. 1A-1D, the heat source 128 comprises a combustion type heat system 130. The combustion type heat system 130 comprises a torch assembly having a nozzle 132 that is coupled to a gas source 134 that is housed behind the front panel 104. The gas source 134 is hidden by the body 102 in FIGS. 1A and 1B, but is shown in FIGS. 1C and 1D. The gas source 134 is in communication with the nozzle 132 by a conduit 136. The nozzle 132 is coupled to an adjustable mount plate 138 that provides support and positioning of the nozzle 132 relative to the body 102 of the case annealing apparatus 100. Specifically, the adjustable mount plate 138 is utilized to adjust the nozzle 132 relative to the case receiving region 125 to provide thermal energy to and end of a case (not shown) disposed in the case receiving region 125. The adjustable mount plate 138 is also utilized to space the nozzle 132 away from the body 102 to minimize heating of the roller plate 120 and other portions of the body 102.

In operation, the feed wheel assembly 118 receives a case (not shown) from the feeding device 110. The feed wheel assembly 118 is rotated to transfer the case to the case receiving region 125 where the case is supported by the roller plate 120. In this position, a portion of the case extends out of the case receiving region 125 and is in proximity to the heat source 128. The heat source 128 may be activated to provide thermal energy to the case. As the case is heated, the case is rotated in a single axis within the case receiving region 125 to allow the thermal energy from the heat source 128 to impinge and treat, e.g., anneal, the entire circumference of the case.

FIGS. 1C and 1D are isometric back views of the case annealing apparatus 100 of FIGS. 1A and 1B. FIG. 1C is back right view of the case annealing apparatus 100. FIG. 1D is a back left view of the case annealing apparatus 100. One embodiment of the gas source 134 is shown in FIG. 1C coupled to the body 102 of the case annealing apparatus 100 by a removable strap 140. The gas source 134 also includes a valve assembly 142 for controlling gas flow to the nozzle 132. In one aspect, the gas source 134 may be a cylinder or bottle containing liquefied petroleum gas (LPG). In one embodiment, the gas source 134 is a 16.4 ounce disposable gas cylinder, which is compact and readily available at hardware and outdoor stores. While the gas source 134 is shown as a compact disposable cylinder, other gas cylinders having a volume greater than 16.4 ounces may be utilized.

The case annealing apparatus 100 also includes a motor 144 which facilitates movement of the roller plate 120 and the feed wheel assembly 118 (both shown in FIGS. 1A and 1B). The motor 144 is coupled to a geared timing wheel 146 by a coupler shaft 148. The motor 144 may be a alternating current (AC) or direct current (DC) actuator or gear motor having an adjustable speed (i.e., revolutions per minute (RPM)) of about 0 RPM to about 2 RPM. The speed of the motor 144 may be adjusted to provide a desired speed for the feed wheel assembly 118 and the roller plate 120 to facilitate a desired dwell time for a cartridge case to be exposed to the heat source 128. In one embodiment, the motor 144 is coupled to an AC power supply (not shown) by a power cord 150. On/off control of the motor 144 is controlled by a switch 152 and RPM is adjusted by a knob controller 154. Both of the switch 152 and the knob controller 154 are coupled to the body 102 in a position that is easily accessible by a user. The geared timing wheel 146 is used to actuate the roller plate 120 as further described in FIGS. 3A and 3B.

FIG. 1D is a back left view of the case annealing apparatus 100. The case annealing apparatus 100 may include an auxiliary power outlet 156 that is coupled to the power source (not shown). The auxiliary power outlet 156 may be used to power other electrical devices that may be utilized with the case annealing apparatus 100, such as a light or other appliance. The auxiliary power outlet 156 may be a duplex type receptacle having a 125 VAC rating. The removable strap 140 is shown in this embodiment as having ends 158A, 158B that are disposed in slots 160 formed through the left side panel 106. The ends 158A and 158B include barbs 162 adapted to engage with the slots 160 when the removable strap 140 is in one position, as shown, in order to secure the gas source 134. One or both of the ends 158A, 158B of the removable strap 140 may also be disengaged with one or both of the slots 160 when the gas source 134 is installed or replaced.

Figure 2A:
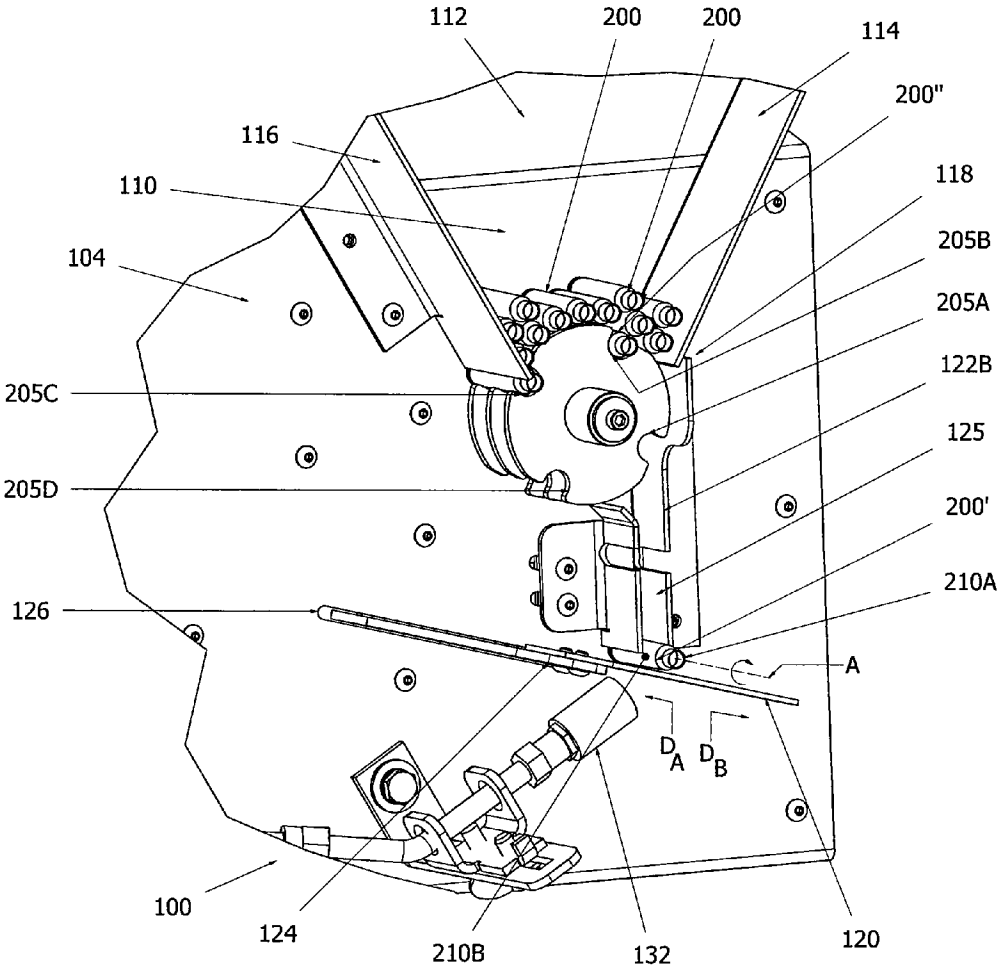
FIGS. 2A and 2B are enlarged isometric views of the case annealing apparatus of FIGS. 1A-1D showing one embodiment of a case transfer and annealing method.
Figure 2B:
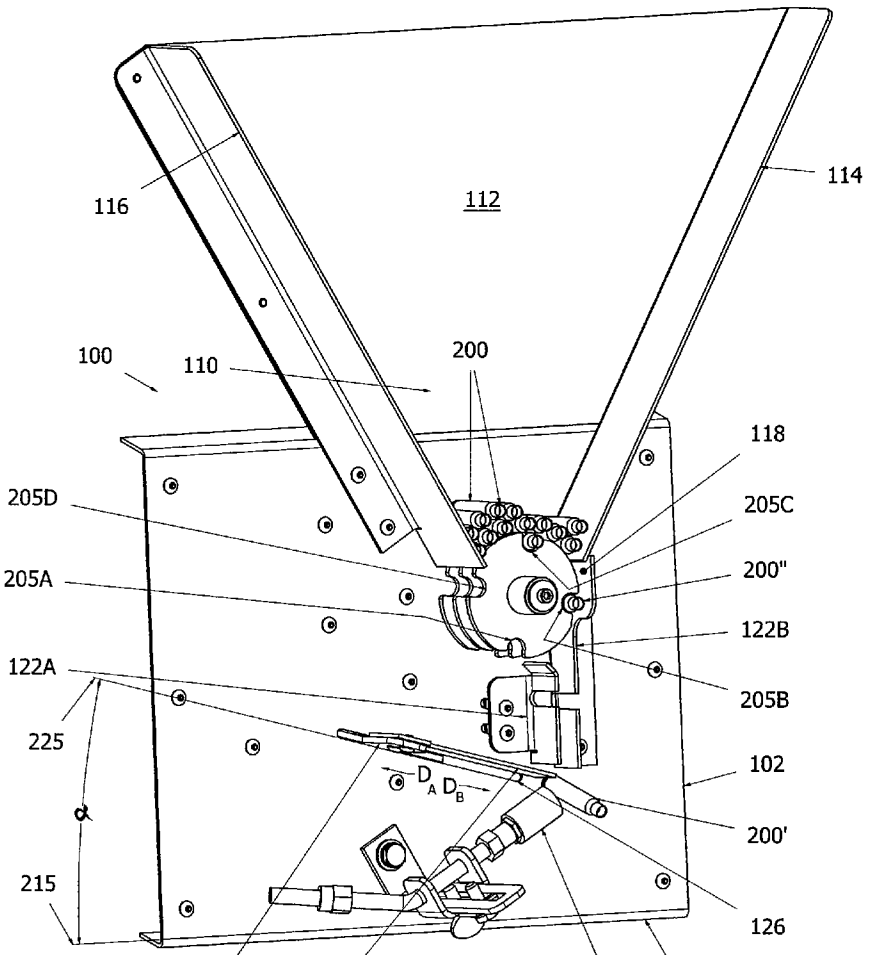

FIGS. 2A and 2B are enlarged isometric views of the case annealing apparatus 100 of FIGS. 1A-1D showing one embodiment of a case transfer and annealing method. One or more cases 200 are shown disposed in the feeding device 110 adjacent the feed wheel assembly 118. The feed wheel assembly 118 includes a plurality of channels 205A-205D that are each adapted to receive a single case 200. While four channels 205A-205D are shown on the feed wheel assembly 118, more or less than four channels 205A-205D may be utilized based on the desired feed rate of the case annealing apparatus 100. The feed wheel assembly 118 rotates clockwise in one embodiment, and cases 200 are received from the feeding device 110 and indexed into respective channels 205A-205D. Each case 200 is contained within the channel 205A-205D and a surface of the second guide rail 122B during rotation of the feed wheel assembly 118. When one of the channels 205A-205D of the feed wheel assembly 118 is rotated to a release position, such as the position of channel 205A, a case 200 is released and drops into the case receiving region 125, as shown by case 200'. In one embodiment, the release region is about the four o-clock position.

The case 200' is subjected to heat treatment in the case receiving region 125 by thermal energy provided by the nozzle 132. The case 200' includes a first end 210A and a second end 210B. Specifically, heat applied from the nozzle 132 is directed to the first end 210A of the case 200' when the case 200' is in the case receiving region 125. When the case 200' is in the case receiving region 125, the roller plate 120 is actuated to move linearly by the geared timing wheel 146. As the case 200' is in contact with the roller plate 120, the movement of the roller plate 120 causes the case 200' to rotate on axis A. The case 200' is restrained from moving laterally by the guide rails 122A and 122B. The rotation of the case 200' in axis A is clockwise when the roller plate 120 is moved in direction $D_A$. While the case 200' is rotated in axis A and is subject to heat treatment, the feed wheel assembly 118 continues to rotate and receive cases 200 from the feeding device 110. For example, case 200" is received in channel 205B and rotated clockwise to the case receiving region 125.

FIG. 2B shows the case 200' falling out of the case receiving region 125. Removal of the case 200' from the case receiving region 125 signals the end of the heat treatment of case 200'. The case 200' may be collected in a bin (not shown) adjacent the case annealing apparatus 100. The length and/or the travel of the roller plate 120 in the direction $D_A$ causes the case 200' to not be supported by the roller plate 120 and thus fall out of the case receiving region 125. Simultaneously, the case 200" is rotated by the feed wheel assembly 118 to the release position. Prior to the case 200" being released from the feed wheel assembly 118, the roller plate 120 is moved in direction $D_B$ to allow the case 200" to be received and supported by the roller plate 120 in the case receiving region 125. The position of the roller plate 120 will be substantially the same as the position of the roller plate 120 in FIG. 2A after the movement in the direction $D_B$. The case 200" may be subjected to heat treatment in the case receiving region 125 in a manner substantially similar to the heat treatment of case 200' described in FIG. 2A. For example, the roller plate 120 moves in the direction $D_A$ to rotate the case 200" on axis A. Simultaneously, channel 205C of the feed wheel assembly 118 receives another case 200 from the feeding device 110. After heat treatment of the case 200", the case 200" falls out of the case receiving region 125. The roller plate 120 moves in the direction $D_B$ to be under the case receiving region 125 in order to facilitate support of the case 200 from channel 205C. The case transfer and annealing method continues until the feeding device 110 is empty and the case transfer operation will not be repeated for the sake of brevity.

In one embodiment, the body 102 of the case annealing apparatus 100 comprises a base 212 disposed in a first plane 215. The first plane 215 may be a horizontal plane. The roller plate 120 includes a support surface 220 adapted to contact a case 200. The support surface 220 of the roller plate 120 is disposed in a second plane 225 that is different than the first plane 215 of the base 212. For example, the first plane 215 may be offset from the second plane 225 by an angle $\alpha$. The angle $\alpha$ may be about 10 degrees to about 45 degrees, such as about 15 degrees to about 30 degrees. The offset of the planes 215, 225 causes the case 200 to be supported by the second guide rail 122B and the support surface 220 of the roller plate 120. The first guide rail 122A provides axial stabilization of the case 200 in the case receiving region 125 during movement of the roller plate 120.

Figure 3A:
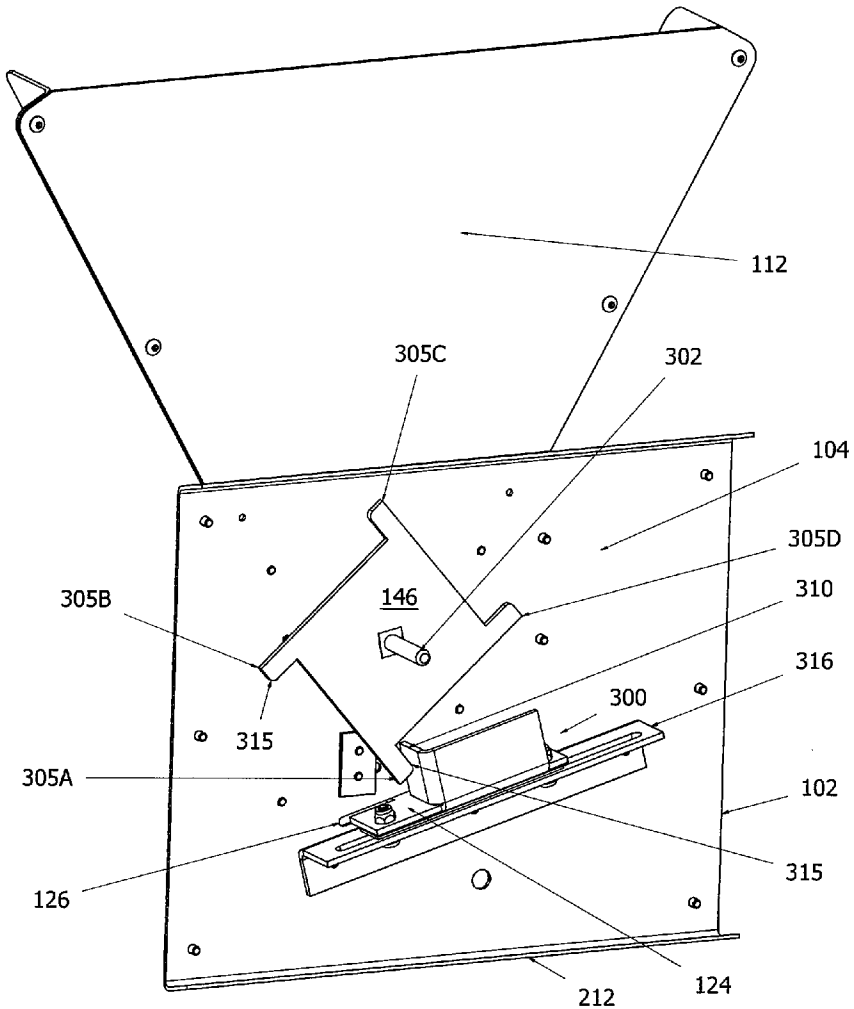
FIGS. 3A and 3B are isometric views of a portion of a case annealing apparatus showing the backside of the body and a linear slide mechanism.
Figure 3B:
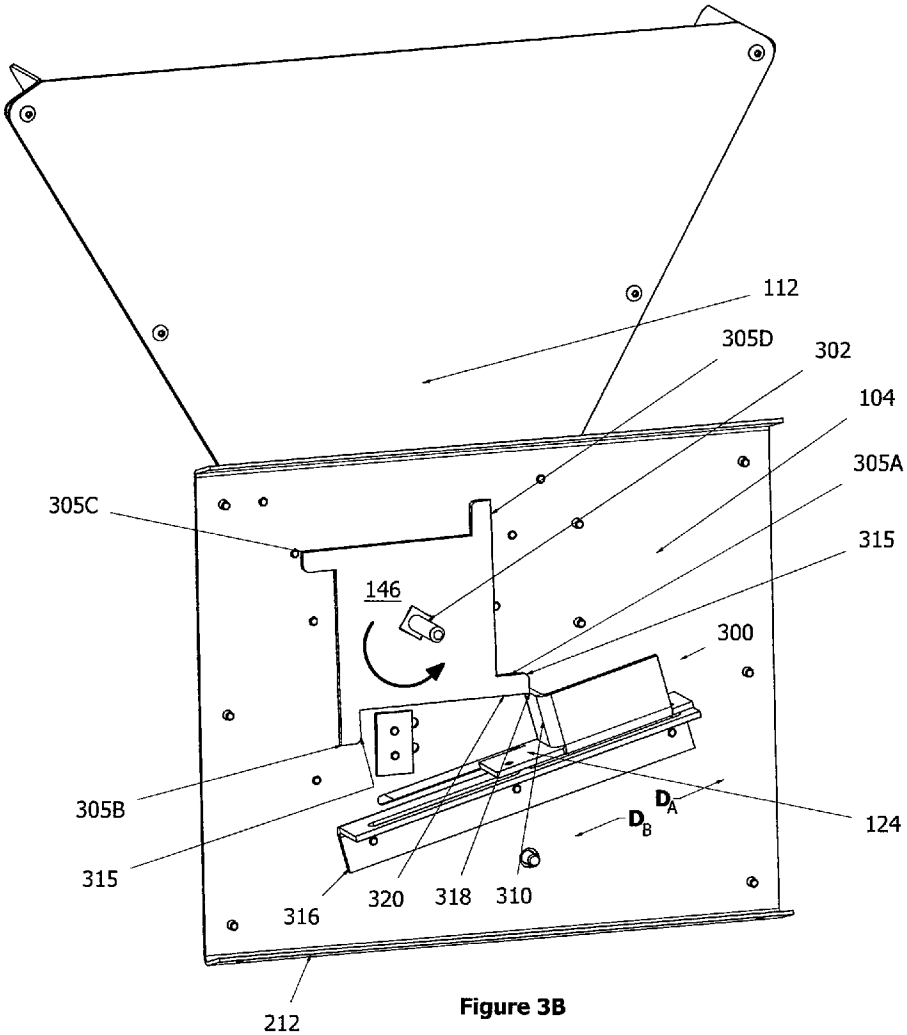

FIGS. 3A and 3B are isometric views of a portion of the case annealing apparatus 100 showing the backside of the body 102 and a linear slide mechanism 300. The geared timing wheel 146 is shown mounted on a shaft 302. The shaft 302 extends through the front panel 104 and is utilized to mount the feed wheel assembly 118 on the opposing side of the front panel 104. The shaft 302 is also coupled to the motor 144 by the coupler shaft 148 (both shown in FIGS. 1C and 1D). Thus, the feed wheel assembly 118 and the geared timing wheel 146 share the shaft 302 and actuation of the motor 144 rotates the geared timing wheel 146 and the feed wheel assembly 118 simultaneously.

Rotation of the shaft 302 by the motor 144 rotates the geared timing wheel 146 in a counterclockwise direction in one embodiment. The geared timing wheel 146 includes one or more teeth 305A-305D that engage with the support member 124, which supports the roller plate 120 on the opposing side of the front panel 104. The support member 124 includes a raised contact plate 310 that is contacted by the teeth 305. As the geared timing wheel 146 is rotated counterclockwise (which coincides with the rotation of the feed wheel assembly 118 (shown in FIGS. 2A and 2B)), a surface 315 of tooth 305A contacts the raised contact plate 310 and pushes the support member 124 in direction $D_A$ relative to a linear support track 316. As the roller plate 120 is coupled to the support member 124, the movement of the support member 124 in the direction $D_A$ results in identical motion of the roller plate 120, as shown in FIG. 2A.

FIG. 3B shows the support member 124 at a near maximum limit of travel in the direction $D_A$. Continued rotation of the geared timing wheel 146 in the counterclockwise direction causes the surface 315 to lose contact with the raised contact plate 310. When a corner 318 of the tooth 305A loses contact with the raised contact plate 310, the support member 124 falls in direction $D_B$ due to gravity, returning the support member 124 to the left-most travel limit or a resting position. The raised contact plate 310 is dimensioned to clear and travel below a surface 320 defined between and end of the tooth 305A and the surface 315 of the tooth 305B. Movement of the support member 124 in the direction $D_B$ is stopped when the raised contact plate 310 contacts the surface 315 of tooth 305B. Continued counterclockwise rotation of the geared timing wheel 146 pushes the support member in the direction $D_A$ as described in FIG. 3A. The oscillating movement of the support member 124 in the directions $D_A$ and $D_B$ continue as described in FIGS. 2A and 2B when the geared timing wheel 146 is rotated counterclockwise during operation.

Figure 4:
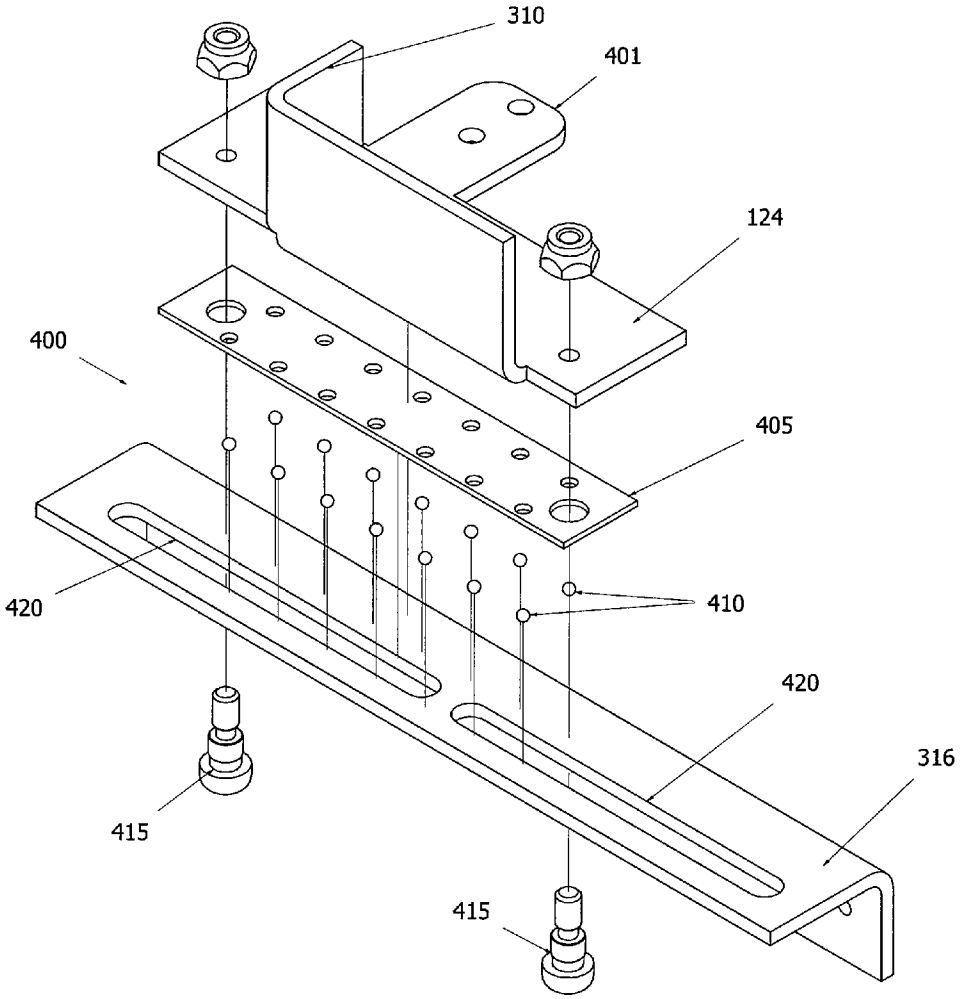
FIG. 4 is an isometric exploded view of the linear slide mechanism of FIGS. 3A and 3B.

FIG. 4 is an isometric exploded view of the linear slide mechanism 300 of FIGS. 3A and 3B. The linear slide mechanism 300 includes a support member 124 and a linear support track 316 with a bearing assembly 400 sandwiched therebetween. The bearing assembly 400 includes a linear race 405 that secures a plurality of roller bearings 410. Fasteners, such as bolts 415, are utilized to secure the support member 124 to the linear support track 316 through slots 420 formed in the linear support track 316. The support member 124 comprises the raised contact plate 310 and a tab 401 that is utilized to couple with the roller plate 120 (FIGS. 2A and 2B).

Figure 5:
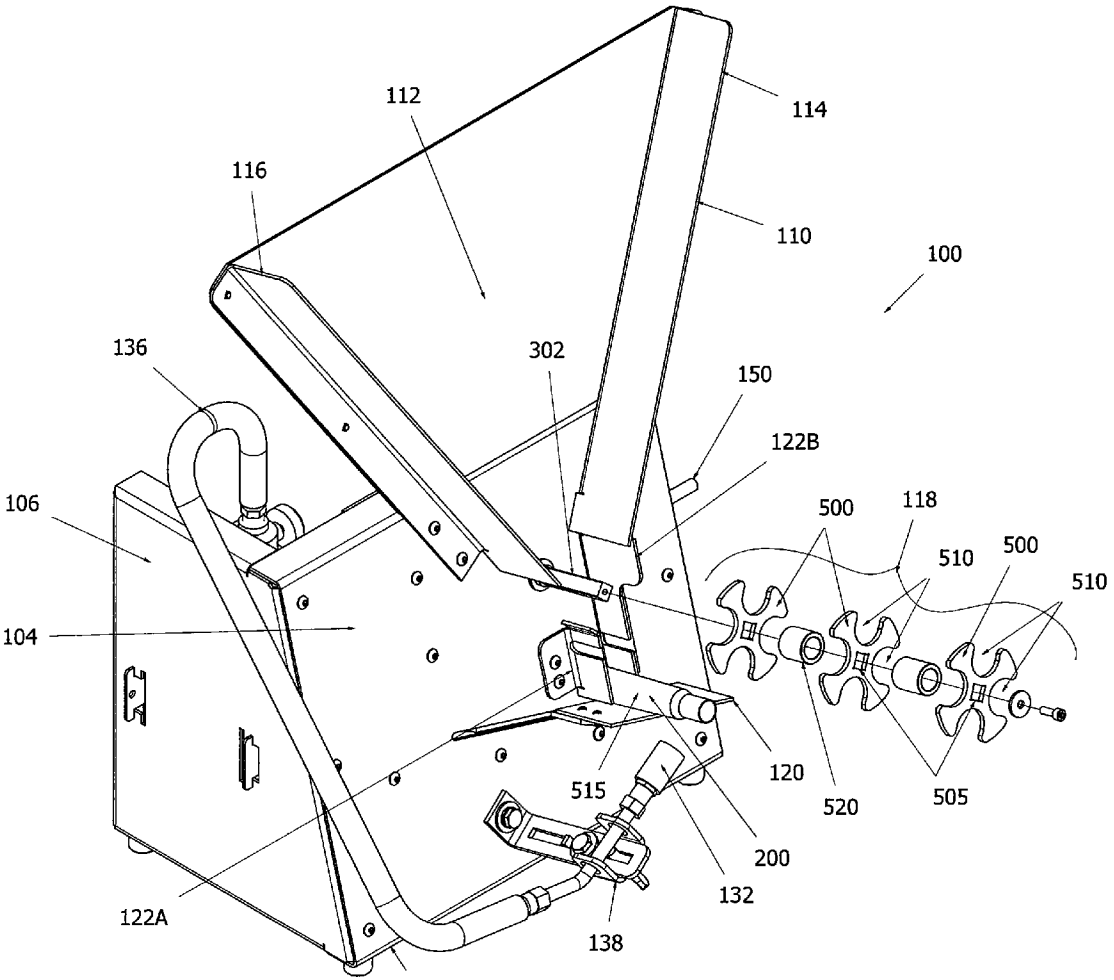
FIG. 5 is an isometric view of the case annealing apparatus showing one embodiment of a feed wheel assembly.

FIG. 5 is an isometric view of the case annealing apparatus 100 showing one embodiment of a feed wheel assembly 118. The feed wheel assembly 118 is exploded away from a shaft 302 that is coupled to a motor 144 via coupler shaft 148 (both shown in FIGS. 1C and 1D). The feed wheel assembly 118 includes one or more support plates 500 that mount to the shaft 302. Each of the support plates 500 include a central through-hole 505 that is received by an outer dimension of the shaft 302. Each of the support plates 500 also include one or more slots 510 that collectively form the channels 205A-205D (shown in FIGS. 2A and 2B). In one embodiment, the shaft 302 and the through-holes 505 are square to facilitate indexing and alignment of the slots 510.

The support plates 500 are coupled to the shaft 302 in a manner that coaxially aligns the slots 510 to define channels that stably support a case 200. Specifically, each slot 510 is sized to receive a diameter of a body 515 of the case 200. The number of support plates 500 may be based on the length of the case 200 to be processed and/or the thickness of the individual support plates 500. The support plates 500 should be sufficient in number, sized and/or spaced to support about two-thirds of the length of the case 200 thereby leaving about one-third of the case 200 unsupported to facilitate heating of the unsupported one-third of the case 200. Thus, the support plates 500 may be two or more thin plates having spacers 520 therebetween. In the embodiment shown, three support plates 500 and two spacers 520 are shown for use with longer length cases, such as casings for .50 caliber cartridges (e.g., cartridges with projectiles having a diameter of about 0.5 inches), such as .50 Browning Machine Gun (BMG) cartridges. However, two support plates 500 and one spacer 520 may be used for smaller cases, such as casings for .223 caliber cartridges (e.g., cartridges with projectiles having a diameter of about 0.2 inches). The feed wheel assembly 118 may be easily coupled to and decoupled from the shaft 302 to facilitate replacement of support plates 500 for casings utilized for different caliber cartridges.

Figure 6:
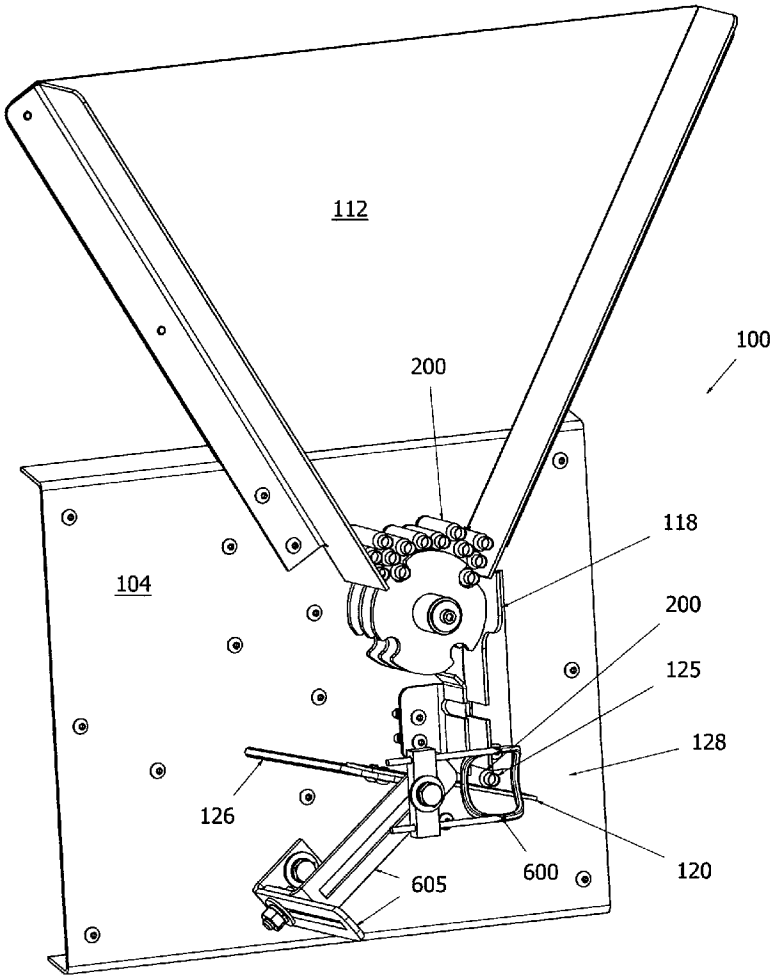
FIG. 6 is an isometric front view of a portion of the case annealing apparatus showing another embodiment of a heat source.

FIG. 6 is an isometric front view of a portion of the case annealing apparatus 100 showing another embodiment of a heat source 128. In this embodiment, the heat source 128 comprises an inductive heating element 600. The inductive heating element 600 is coupled to an adjustable support device 605 to facilitate positioning of the inductive heating element 600 relative to the case receiving region 125. The inductive heating element 600 is sized, shaped and positioned to provide heat to the end of the case 200 when the case 200 is in the case receiving region 125 without interfering the case 200 entering or exiting the case receiving region 125, as well as not interfering with movement of the case 200 in the case receiving region 125. For example, the inductive heating element 600 may be U-shaped or shaped to include a concave region that receives an end of the case 200 and directs heat to the end of the case 200 without restricting travel or transfer of the case 200.

Figure 7:
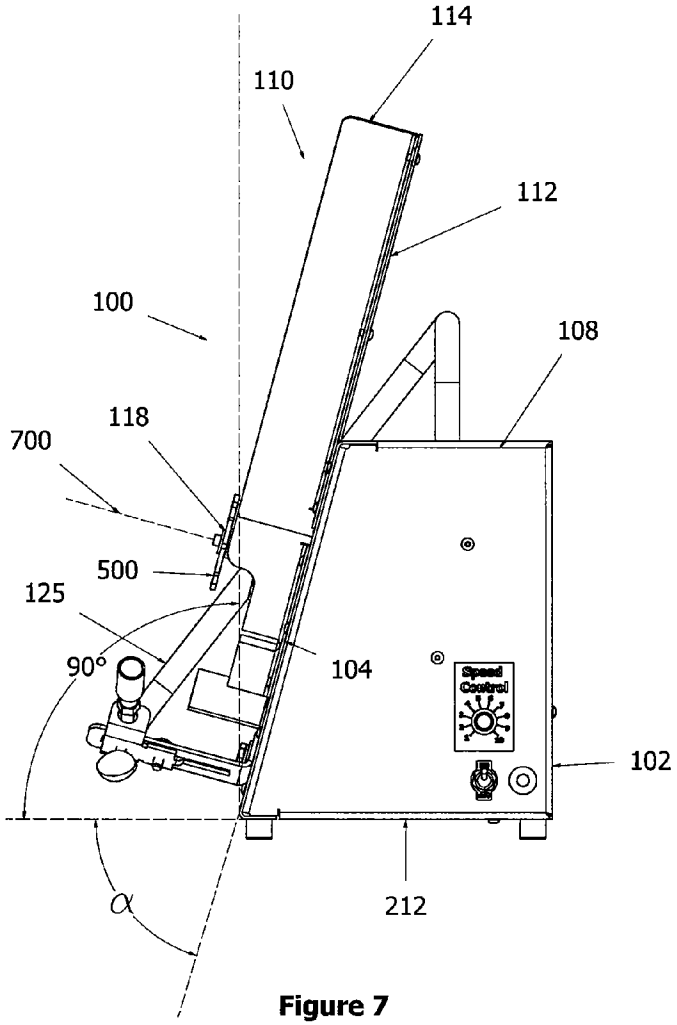
FIG. 7 is a side view of the case annealing apparatus showing an angular offset of the body of the case annealing apparatus.

FIG. 7 is a side view of the case annealing apparatus 100 showing an angular offset of the body 102 of the case annealing apparatus 100. The body 102 comprises a base 212 disposed in a first horizontal plane and the front panel 104 is disposed in a second vertical plane in an acute angle relative to the first horizontal plane. The front panel 104 may be disposed at an angle $\alpha$ off of the second vertical plane to facilitate holding of cases (not shown) in the case receiving region 125. The angle $\alpha$ may be an acute angle that is less than 90 degrees, such as about 85 degrees to about 65 degrees, or less, for example, about 80 degrees to about 70 degrees. Likewise, the back plate 112 may be coplanar with the front panel 104 to ensure cases in the feeding device 110 do not fall out of the feeding device 110. Additionally, an axis 700 of the shaft 302 (shown in FIG. 5) is substantially normal to the plane of the front panel 104 to enable stable support of cases 200 (shown in FIG. 5) in the channels of the support plates 500 (only a distal support plate 500 is shown in this view).

Embodiments of the case annealing apparatus 100 as described herein provide an annealing device adapted for higher throughput with minimal operational monitoring by personnel. Additionally, the case annealing apparatus 100 occupies a smaller footprint. The case annealing apparatus 100 as described herein provides a feeding device 110 that holds a plurality of cases and feeds single cases to a case receiving region 125. Single cases are received from the feeding device 110 by a feed wheel assembly 118, which indexes the case and feeds the case to the case receiving region 125. Each of the cases are rotated in a fixed rotational axis in the case receiving region 125 while being impinged by heat from the heat source 128. Rotation of the case in the case receiving region 125 is provided by a linear slide mechanism 300 having a roller plate 120 that supports the case in a portion of a linear travel path that moves away from the case at a point to disengage the case after heat treatment. Movement of the roller plate 120 to provide rotation and support of the case in the case receiving region 125, as well as the rotation of the feed wheel assembly 118 is governed by a drive mechanism comprising a geared timing wheel 146 that is coupled to the feed wheel assembly 118 by a common shaft to a single motor 144.

While the foregoing is directed to embodiments of the invention, other and further embodiments of the invention may be devised without departing from the basic scope thereof.

What is claimed is:

1. A case transfer apparatus for annealing cartridges, the case transfer apparatus comprising:

a base;

a motor disposed on the base;

a rotatable feed wheel assembly disposed on the base and coupled to the motor, the rotatable feed wheel assembly adapted to receive at least one case via gravitational force from a feeding device; and a roller plate coupled to the motor and disposed adjacent the rotatable feed wheel assembly within a case receiving region where the at least one case is rotated and heated.

2. The case transfer apparatus of claim 1, further comprising:

a geared timing wheel interfaced with the motor and the roller plate.

3. The case transfer apparatus of claim 1, wherein the rotatable feed wheel assembly comprises two or more support plates separated by a spacer.

4. The case transfer apparatus of claim 3, wherein each of the support plates include at least one slot formed in an outer surface thereof, the slots being aligned to receive a portion of the at least one case.

5. The case transfer apparatus of claim 1, wherein the case receiving region is defined by an upper surface of the roller plate, and a first guide rail and a second guide rail spaced apart from the first guide rail.

6. The case transfer apparatus of claim 1, wherein the feeding device is coupled to the base and oriented at an acute angle relative to a horizontal plane of the base.

7. The case transfer apparatus of claim 1, wherein the roller plate is disposed at an acute angle relative to a horizontal plane of the base.

8. The case transfer apparatus of claim 1, further comprising:

a heating device disposed adjacent the case receiving region, the heating device operable to heat a portion of the at least one case retained in the case receiving region.

9. The case transfer apparatus of claim 8, wherein the heating device comprises a torch assembly or an inductive heater.

10. A case transfer apparatus for annealing cartridges, the case transfer apparatus comprising:

a base;

a motor coupled to the base;

a feed wheel assembly coupled by a shaft to the motor;

a linear slide mechanism disposed adjacent the feed wheel assembly, the linear slide mechanism movable in a linear direction that is controlled by the motor; and a case receiving region comprising two spaced-apart guide rails disposed between the feed wheel assembly and the linear slide mechanism where at least one case is rotated and heated.

11. The case transfer apparatus of claim 10, further comprising:

a geared timing wheel coupled to the shaft between the feed wheel assembly and the motor.

12. The case transfer apparatus of claim 10, wherein, the base includes a front panel that is oriented in an acute angle relative to a horizontal plane of the base.

13. The case transfer apparatus of claim 10, wherein the linear slide mechanism is oriented at an acute angle relative to a horizontal plane of the base.

14. The case transfer apparatus of claim 10, wherein the feed wheel assembly comprises two or more support plates separated by a spacer.

15. The case transfer apparatus of claim 14, wherein each of the two or more support plates include at least one slot formed in an outer surface thereof and each slot is substantially coaxially aligned.

16. The case transfer apparatus of claim 10, wherein the linear slide mechanism is coupled to the motor through a slot formed in a front panel of the base.

17. A case transfer apparatus for annealing cartridges, the case transfer apparatus comprising:

a body comprising a front panel and two opposing walls, the front panel oriented in an acute angle relative to a horizontal plane of the body;

a feeding device coupled to and coplanar with the front panel;

a rotatable feed wheel assembly disposed adjacent an end of the feeding device; and a linear slide mechanism disposed adjacent the rotatable feed wheel assembly defining a case receiving region comprising two spaced-apart guide rails disposed between the feed wheel assembly and the linear slide mechanism where at least one case is rotated and heated in a fixed rotational axis.

18. The case transfer apparatus of claim 17, wherein the rotatable feed wheel assembly comprises two or more support plates separated by a spacer, each of the support plates including at least one slot formed in an outer surface thereof, and the slots in each support plate are substantially coaxially aligned.

19. The case transfer apparatus of claim 17, wherein rotation of the rotatable feed wheel assembly and movement of the linear slide mechanism are controlled by a common motor.

20. The case transfer apparatus of claim 17, wherein the linear slide mechanism is oriented at an acute angle relative to a horizontal plane of the body.

* * * * *